US006315661B1

(12) United States Patent
O'Garra

(10) Patent No.: US 6,315,661 B1
(45) Date of Patent: Nov. 13, 2001

(54) CASINO-TYPE GAME

(76) Inventor: Burt O'Garra, 1301 E. New York Ave., Brooklyn, NY (US) 11212

( * ) Notice: Subject to any disclaimer, the term of this patent is extended or adjusted under 35 U.S.C. 154(b) by 0 days.

(21) Appl. No.: 09/556,990

(22) Filed: Apr. 24, 2000

(51) Int. Cl.[7] ..... A63F 9/24
(52) U.S. Cl. ..... 463/16; 273/287
(58) Field of Search ..... 273/146, 274, 273/287, 236, 283, 309; 463/10, 11, 9, 16, 17, 22

(56) References Cited

U.S. PATENT DOCUMENTS 3,927,886 * 12/1975 Day ..... 273/135 R
4,324,406 * 4/1982 Ocampo ..... 273/242
4,688,803 * 8/1987 Ollington ..... 273/274
5,228,698 * 7/1993 Dubarry, Jr. ..... 273/256
5,758,878 * 6/1998 Brown ..... 273/274
5,833,238 * 11/1998 Watanabe ..... 273/236
6,062,563 * 5/2000 De Keller ..... 273/274
6,077,079 * 6/2000 Barnes ..... 434/128
6,089,871 * 7/2000 Jaffe ..... 434/209

* cited by examiner

*Primary Examiner*—Jessica J. Harrison
*Assistant Examiner*—Kim T. Nguyen

(57) ABSTRACT

A casino-type game including a game board with a rectangular configuration having an upper surface and a lower surface. The upper surface of the game board has a first set of three circles situated thereon with the numerals "1", "2", & "3" positioned therein, respectively. A second set of three circles is also situated on the upper surface of the game board with the numerals "4", "5", & "6" positioned therein, respectively. The upper face of the game board further includes a first diagonally situated square, a second diagonally situated square, a third diagonally situated square, and a fourth diagonally situated square each with a unique game indicia formed therein. Each game indicia corresponds to a unique set of rules associated with the method of the game. Finally, included is a plurality of dice each with six sides having a unique number situated thereon.

2 Claims, 3 Drawing Sheets

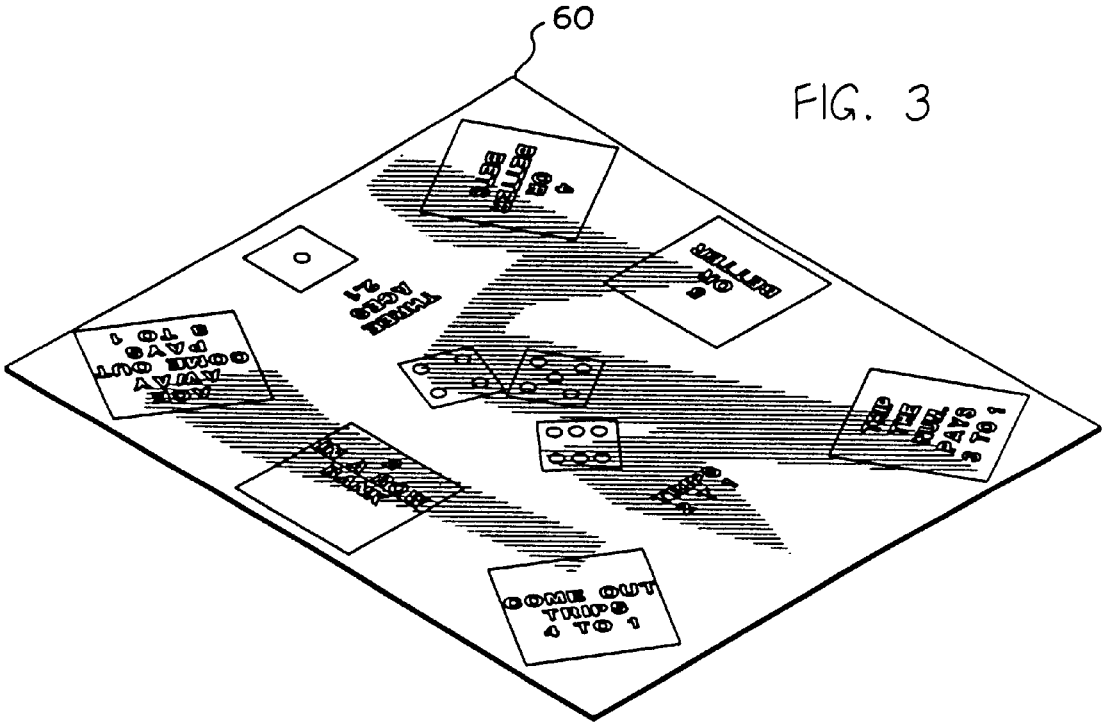
FIG. 3
FIG. 4
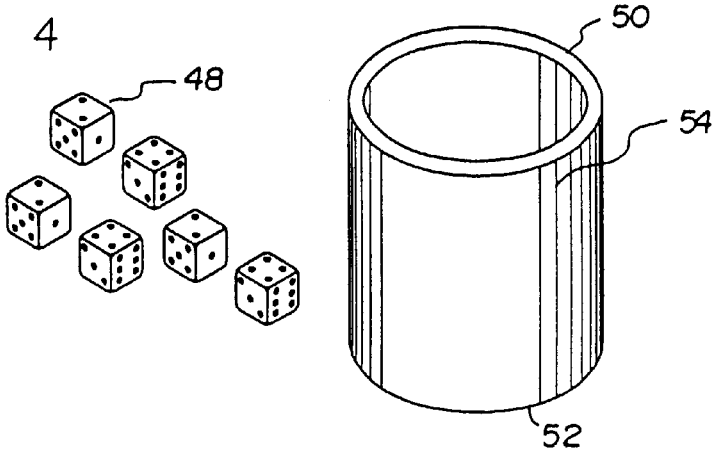
FIG. 5
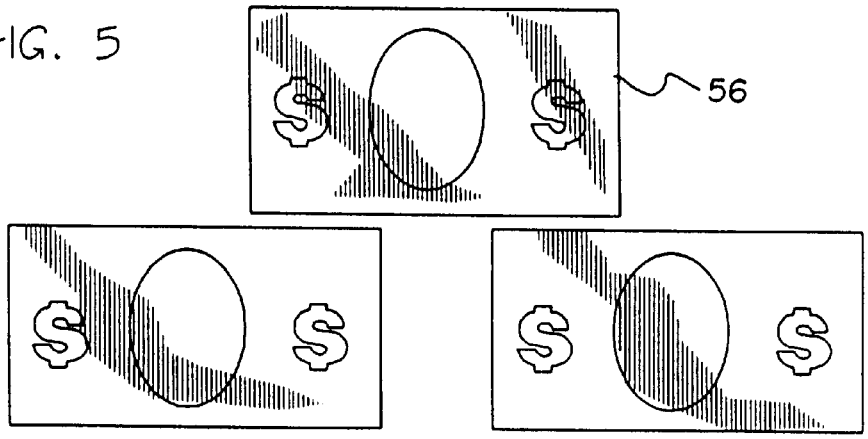

FIG. 6

| | | | | | | | | | | | | | | |
|---|---|---|---|---|---|---|---|---|---|---|---|---|---|---|
| 111 | 135 | 162 | 225 | 252 | 315 | 342 | 365 | 432 | 455 | 522 | 545 | 612 | 635 | 662 |
| 112 | 136 | 163 | 226 | 253 | 316 | 343 | 366 | 433 | 456 | 523 | 546 | 613 | 636 | 663 |
| 113 | 141 | 164 | 231 | 254 | 321 | 344 | 411 | 434 | 461 | 524 | 551 | 614 | 641 | 664 |
| 114 | 142 | 165 | 232 | 255 | 322 | 345 | 412 | 435 | 462 | 525 | 552 | 615 | 642 | 665 |
| 115 | 143 | 166 | 233 | 256 | 323 | 346 | 413 | 436 | 463 | 526 | 553 | 616 | 643 | 666 |
| 116 | 144 | 211 | 234 | 261 | 324 | 351 | 414 | 441 | 464 | 531 | 554 | 621 | 644 | S |
| 121 | 145 | 212 | 235 | 262 | 325 | 352 | 415 | 442 | 465 | 532 | 555 | 622 | 645 | T |
| 122 | 146 | 213 | 236 | 263 | 326 | 353 | 416 | 443 | 466 | 533 | 556 | 623 | 646 | R |
| 124 | 151 | 214 | 241 | 264 | 331 | 354 | 421 | 444 | 511 | 534 | 561 | 624 | 651 | I |
| 125 | 152 | 215 | 242 | 265 | 332 | 355 | 422 | 445 | 512 | 535 | 562 | 625 | 652 | G |
| 126 | 153 | 216 | 243 | 266 | 333 | 356 | 423 | 446 | 513 | 536 | 563 | 626 | 653 | H |
| 131 | 154 | 221 | 244 | 311 | 334 | 361 | 424 | 451 | 514 | 541 | 564 | 631 | 654 | T |
| 132 | 155 | 222 | 245 | 312 | 335 | 362 | 425 | 452 | 515 | 542 | 565 | 632 | 655 | H |
| 133 | 156 | 223 | 246 | 313 | 336 | 363 | 426 | 453 | 516 | 543 | 566 | 633 | 656 | I |
| 134 | 161 | 224 | 251 | 314 | 341 | 364 | 431 | 454 | 521 | 544 | 611 | 634 | 661 | T'S |
| | | T | R | I | P | S | 111 | 222 | 333 | 444 | 555 | 666 | | |

CASINO-TYPE GAME

BACKGROUND OF THE INVENTION

1 Field of the Invention

The present invention relates to a casino-type game and more particularly pertains to providing a uniquely configured game board for allowing betting under various terms.

2. Description of the Prior Art

The use of board games is known in the prior art. More specifically, board games heretofore devised and utilized for the purpose of providing amusement are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. Nos. 5,133,559 to Page; 5,364,101 to Spooner et al.; U.S. Pat. No. Des. 269,983 to Lapadura; U.S. Pat. Nos. 4,688,803 to Ollington; 5,397,128 to Hesse et al.; and 5,169,154 to Borghi.

In this respect, the casino-type game according to the present invention substantially departs from the conventional concepts and designs of the prior art, and in so doing provides an apparatus primarily developed for the purpose of providing a uniquely configured game board for allowing betting under various terms.

Therefore, it can be appreciated that there exists a continuing need for a new and improved casino-type game which can be used for providing a uniquely configured game board for allowing betting under various terms. In this regard, the present invention substantially fulfills this need.

SUMMARY OF THE INVENTION

In view of the foregoing disadvantages inherent in the known types of board games now present in the prior art, the present invention provides an improved casino-type game. As such, the general purpose of the present invention, which will be described subsequently in greater detail, is to provide a new and improved casino-type game which has all the advantages of the prior art and none of the disadvantages.

To attain this, the present invention essentially comprises a game board with a rectangular configuration having an upper surface and a lower surface. As shown in FIG. 2, the upper surface of the game board has a rectangular matrix of interconnected horizontal and vertical lines centrally formed thereon. Such lines define a plurality of rows and columns of squares. The matrix has a long top edge, a long bottom edge, a short first side edge and a short second side edge. The upper surface of the game board further has a first set of three circles situated thereon adjacent the first side edge of the matrix with the numerals "1", "2", & "3" positioned therein, respectively. Associated therewith is a second set of three circles situated on the upper surface of the game board adjacent the second side edge of the matrix. The numerals "4", "5", & "6" are positioned within the associated circles of the second set. See FIG. 2. A third set of three circles are also situated on the upper surface of the game board. The third set of three circles reside adjacent the top edge of the matrix with a first game indicia, a second game indicia, and a second game indicia formed therein, respectively. With reference still to FIG. 2, a plurality of boxes are provided. The boxes are positioned on the upper surface of the game board adjacent the bottom edge of the matrix. It should be noted that the boxes are in alignment with an associated column of squares of the matrix. Further, such boxes have the numerals "1", "2", "3", "4", "5", & "6" positioned therein, respectively. The upper face of the game board further includes a first diagonally situated square positioned adjacent the upper edge and first side edge of the matrix with a fourth game indicia formed therein. See FIG. 2. A second diagonally situated square is positioned adjacent the upper edge and second side edge of the matrix. A fifth game indicia is formed therein. Yet another square, a third diagonally situated square, is positioned adjacent the bottom edge and first side edge of the matrix. A sixth game indicia is formed therein. Finally, a fourth diagonally situated square is positioned adjacent the bottom edge and second side edge of the matrix with a seventh game indicia formed therein. The nature and function of the foregoing adjacent indicia will be discussed in greater detail hereinafter. A stand is included having a rigid support plate with a rectangular configuration for supporting the game board thereon. As shown in FIG. 1, the stand further has a leg connected to each respective corner of the support plate thereof and depending downwardly therefrom. By such structure, the legs are adapted for supporting the support plate and game board at an elevated position with respect to the ground. As shown in FIG. 4, a plurality of dice are provided each with six sides having a unique number situated thereon. With reference to FIG. 5, it can be seen that a plurality of pieces of money is also included.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved casino-type game which has all the advantages of the prior art board games and none of the disadvantages.

It is another object of the present invention to provide a new and improved casino-type game which may be easily and efficiently manufactured and marketed.

It is a further object of the present invention to provide a new and improved casino-type game which is of a durable and reliable construction.

An even further object of the present invention is to provide a new and improved casino-type game which is susceptible of a low cost of manufacture with regard to both materials and labor, and which accordingly is then susceptible of low prices of sale to the consuming public, thereby making such casino-type game economically available to the buying public.

Still yet another object of the present invention is to provide a new and improved casino-type game which provides in the apparatuses and methods of the prior art some of the advantages thereof, while simultaneously overcoming some of the disadvantages normally associated therewith.

Still another object of the present invention is to provide a uniquely configured game board for allowing betting under various terms.

Lastly, it is an object of the present invention to provide a new and improved casino-type game including a game board with a rectangular configuration having an upper surface and a lower surface. The upper surface of the game board has a first set of three circles situated thereon with the numerals "1", "2", & "3" positioned therein, respectively. A second set of three circles is also situated on the upper surface of the game board with the numerals "4", "5", & "6" positioned therein, respectively. The upper face of the game board further includes a first diagonally situated square, a second diagonally situated square, a third diagonally situated square, and a fourth diagonally situated square each with a unique game indicia formed therein. Each game indicia corresponds to a unique set of rules associated with the method of the game. Finally, included is a plurality of dice each with six sides having a unique number situated thereon.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a perspective view an alternate embodiment of the present invention.

FIG. 4 is a perspective view of the dice and associated shaker of the present invention.

FIG. 5 is a top view of the money employed in the present invention.

Similar reference characters refer to similar parts throughout the several views of the drawings.

DESCRIPTION OF THE PREFERRED EMBODIMENT

Figure 1:
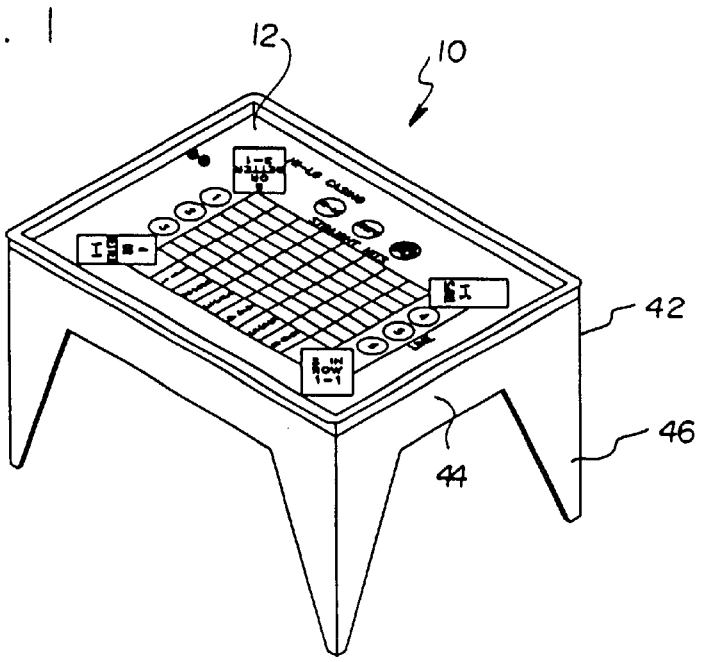
FIG. 1 is a perspective illustration of the preferred embodiment of the casino-type game constructed in accordance with the principles of the present invention.

With reference now to the drawings, and in particular to FIG. 1 thereof, a new and improved casino-type game embodying the principles and concepts of the present invention and generally designated by the reference numeral 10 will be described.

The present invention, the new and improved casino-type game, is comprised of a plurality of components. Such components in their broadest context include a game board, stand, dice, and money. Such components are individually configured and correlated with respect to each other so as to attain the desired objective.

Figure 2:
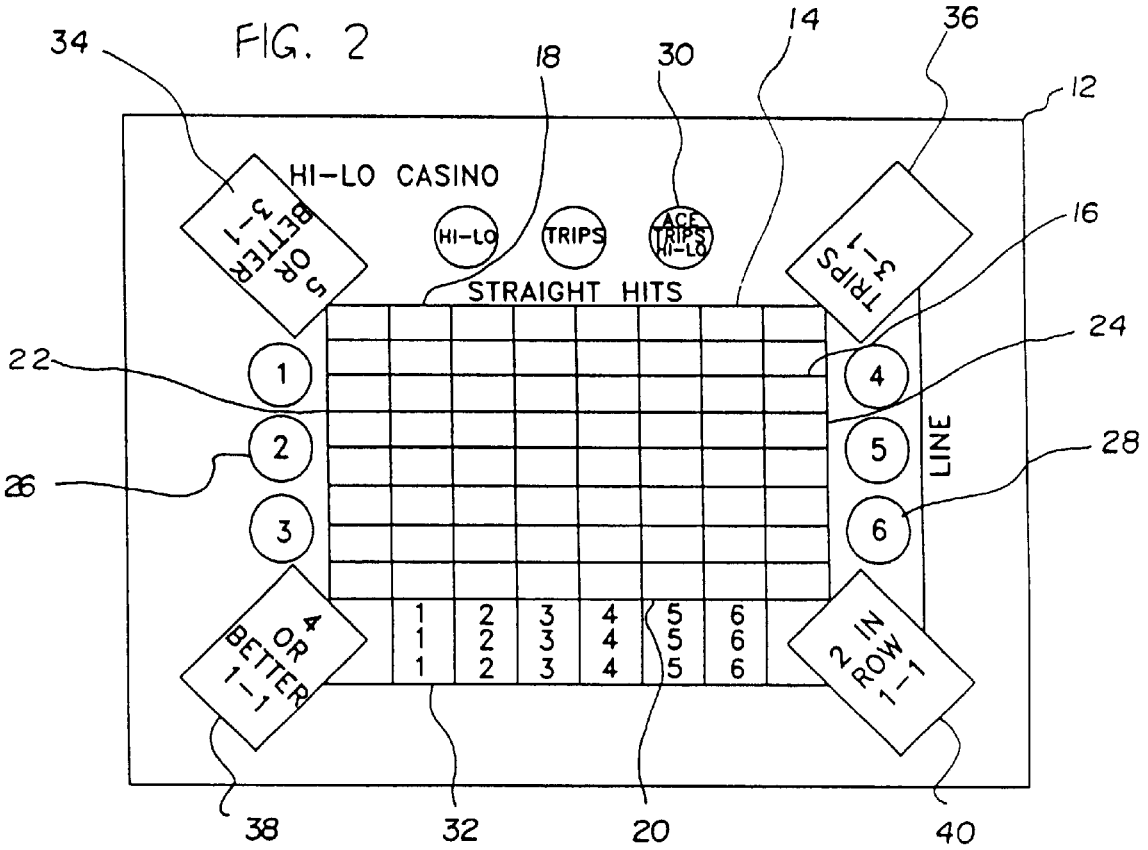
FIG. 2 is a top plan view of the upper surface of the game board of the present invention.

More specifically, it will be noted that the system 10 of the present invention includes a game board 12 with a rectangular configuration having an upper surface and a lower surface. As shown in FIG. 2, the upper surface of the game board has a rectangular matrix 14 of interconnected horizontal and vertical lines 16 centrally formed thereon. Such lines define a plurality of rows and columns of squares. The matrix has a long top edge 18, a long bottom edge 20, a short first side edge 22 and a short second side edge 24 which contains a combination of numbers.

The upper surface of the game board further has a first set of three circles 26 situated thereon adjacent the first side edge of the matrix with the numerals "1", "2", & "3" positioned therein, respectively. Associated therewith is a second set of three circles 28 situated on the upper surface of the game board adjacent the second side edge of the matrix. The numerals "4", "5", & "6" are positioned within the associated circles of the second set. See FIG. 2. A third set of three circles 30 are also situated on the upper surface of the game board. The third set of three circles reside adjacent the top edge of the matrix with a first game indicia, a second game indicia, and a second game indicia formed therein, respectively.

With reference still to FIG. 2, a plurality of boxes 32 are provided. The boxes are positioned on the upper surface of the game board adjacent the bottom edge of the matrix. It should be noted that the boxes are in alignment with an associated column of squares of the matrix. Further, such boxes have the numerals "1", "2", "3", "4", "5", & "6" positioned therein, respectively.

The upper face of the game board further includes a first diagonally situated square 34 positioned adjacent the upper edge and first side edge of the matrix with a fourth game indicia formed therein. See FIG. 2. A second diagonally situated square 36 is positioned adjacent the upper edge and second side edge of the matrix. A fifth game indicia is formed therein. Yet another square, a third diagonally situated square 38, is positioned adjacent the bottom edge and first side edge of the matrix. A sixth game indicia is formed therein. Finally, a fourth diagonally situated square 40 is positioned adjacent the bottom edge and second side edge of the matrix with a seventh game indicia formed therein. The nature and function of the foregoing indicia will be discussed in greater detail hereinafter.

A stand 42 is included having a rigid support plate 44 with a rectangular configuration for supporting the game board thereon. As shown in FIG. 1, the stand further has a leg 46 connected to each respective corner of the support plate thereof and depending downwardly therefrom. By such structure, the legs are adapted for supporting the support plate and game board at an elevated position with respect to the ground.

As shown in FIG. 4, a plurality of dice 48 are provided each with six sides having a unique number situated thereon.

With reference to FIG. 5, it can be seen that a plurality of pieces of money 56 is also included. It should be noted that the money may take the form of either bills or chips.

The method associated with the present invention will now be set forth. In the most general terms, the steps of using the present invention includes: rolling the dice by a designated person, placing a certain amount of the money on one of the game indicia, one player rolling the dice to make a point while bets are made by other players, and exchanging the money in accordance with a unique set of terms relating to each game indicia. In the present invention, every player alternately takes a turn. Preferably, each player stands in line adjacent the game board at the second side edge of the matrix.

Specifically, the terms, or rules, associated with the first indica, "Hi-Lo", requires a person to roll the dice and record, either mentally or on paper, what was rolled. Subsequently, a player whose turn is next rolls a higher number of dice. If the total value of the dice is less than or equal to the value rolled by the person before them, the player must forfeit the money that was wagered. If, however, the total value of the dice is greater than the value rolled by the person before them, the present player is given an amount of money equivalent to that which he wagered.

Associated with the second indicia, "trips", is yet another set of rules. Upon placing money on the second indicia, the player must roll three identical dice that match at least one of those rolled by the designated person. If he wins, the player is paid 4 times the money that was wagered.

The third indicia, "ace/trips/hi-lo", is representative of a set of rules that includes the terms of the first and second indicia in addition to another set of terms. Such set of terms dictate that if the dice are rolled such that a "1" appears, the present player loses automatically.

The rules corresponding to the fourth indicia, "5-or-better", are similar to those associated with the first indicia, "hi-lo", except that the present player must roll the dice such that the total value thereof is at least 5 more than that rolled by the designated person. If the present player does so, he is awarded 3 times the amount that was wagered.

The fifth indicia, "trips 3-1", has rules similar to those of the second indicia, "trips", except that the present player need not match a value with one that was rolled by the designated person. Commensurate with the increased odds, the player is only awarded 3 times the amount that was wagered. As such, the present play is independent of what the designated person rolls.

It should be noted that the sixth indicia, "4-or-better", has rules similar to the fourth indicia, "5-or-better", with the exception of requiring the present player to roll a total value of only 4 or 5 which is "4-or-better" or 6 which is than 4. Any number under 4 looses "4-or-better". Such is similar with "5-or-better." Further, the present terms only pay twice the amount wagered.

The sixth indicia, "2-in-row", is playable when the designated person rolls a "2". The next two players in a row must throw 2 or more to win. A win under the present terms awards the present player by doubling his money.

Finally, further terms and rules are associated with the first and second set of circles and boxes of the matrix. If money is placed on any one of the first or second set of circles, the money is doubled when only one of the dice shows the indicia within the circle bet upon, tripled when two of the dice show the indicia within the circle bet upon, and quadrupled if all three of the dice show the indicia within the circle bet upon. Yet another set of rules is present if money is positioned lengthwise across the entire second set of circles. If such bet is placed and a "4", "5",and "6" is rolled, all subsequent players must pay the amount wagered by the present player if the bank should roll a "4", "5", and "6" during their turn. Associated with the boxes is yet another set of terms. Upon placing a wager within one of the boxes and rolling the dice, the present player is paid ten times the amount wagered if the dice show 3 of a kind which match the numbers within the box. As shown in FIG. 2, the boxes each have three numbers printed therein. A combination of numbers are printed in the center of each of the boxes.

In an alternate embodiment 60 of the present invention, the stand is excluded and the game board is simplified by removing the various indicia and corresponding possible games. Note FIG. 3. Associated with the dice of the alternate embodiment is a dice shaker 50 having a cylindrical configuration. Such shaker is defined by a circular bottom 52 and a periphery 54 coupled thereto and extended upwardly to define an interior space and open top for shaking dice therein and dispensing them thereafter. It should be understood that in the present embodiment, the players roll and all bets are wagered on a specific game or game indicia prior to any of the players taking their turn.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved casino type game comprising:

a game board with a rectangular configuration having an upper surface and lower surface, the upper surface of the game board having a rectangular matrix of interconnected horizontal and vertical lines centrally formed thereon thereby defining a plurality of rows and columns of squares, the matrix having a long top edge, a long bottom edge, a short first side edge and a short second side edge, the upper surface of the game board further having a first set of three circles situated thereon adjacent the first side edge of the matrix with the numerals "1", "2", & "3" positioned therein, respectively, a second set of three circles situated thereon adjacent the second side edge of the matrix with the numerals "4", "5", & "6" positioned therein, respectively, a third set of three circles situated thereon adjacent the top edge of the matrix with a first game indicia, a second game indicia, and a third game indicia formed therein, respectively, and a plurality of boxes positioned thereon adjacent the bottom edge of the matrix with the boxes being in alignment with an associated column of squares of the matrix and further having the numerals "1", "2", "3" "4""5", & "6" positioned therein, respectively, the upper face of the game board further including a first diagonally situated square positioned adjacent the upper edge and first side edge of the matrix with a fourth game indicia formed therein, a second diagonally situated square positioned adjacent the upper edge and second side edge of the matrix with a fifth game indicia formed therein, a third diagonally situated square positioned adjacent the bottom edge and first side edge of the matrix with a sixth game indicia formed therein, and a fourth diagonally situated square positioned adjacent the bottom edge and second side edge of the matrix with a seventh game indicia formed therein;

a stand having a rigid support plate with a rectangular configuration for supporting the game board thereon, the stand further having a leg connected to each respective corner of the support plate thereof and depending downwardly therefrom for supporting the support plate and game board at an elevated position with respect to the ground;

a plurality of dice each with six sides having a unique number situated thereon; and a plurality of pieces of money.

2. A new and improved method of playing a casino game:

providing a game board with a rectangular configuration having an upper surface and lower surface, the upper surface of the game board having a rectangular matrix of interconnected horizontal and vertical lines centrally formed thereon thereby defining a plurality of rows and columns of squares, the matrix having a long top edge, a long bottom edge, a short first side edge and a short second side edge, the upper surface of the game board further having a first set of three circles situated thereon adjacent the first side edge of the matrix with the numerals "1", "2", & "3" positioned therein, respectively, a second set of three circles situated thereon adjacent the second side edge of the matrix with the numerals "4", "5", & "6" positioned therein, respectively, a third set of three circles situated thereon adjacent the top edge of the matrix with a first game indicia, a second game indicia, and a third game indicia formed therein, respectively, and a plurality of boxes positioned thereon adjacent the bottom edge of the matrix with the boxes being in alignment with an associated column of squares of the matrix and further having the numerals "1", "2", "3", "4", "5", & "6" positioned therein, respectively, the upper face of the game board further including a first diagonally situated square positioned adjacent the upper edge and first side edge of the matrix with a fourth game indicia formed therein, a second diagonally situated square positioned adjacent the upper edge and second side edge of the matrix with a fifth game indicia formed therein, a third diagonally situated square positioned adjacent the bottom edge and first side edge of the matrix with a sixth game indicia formed therein, and a fourth diagonally situated square positioned adjacent the bottom edge and second side edge of the matrix with a seventh game indicia formed therein;

providing a stand having a rigid support plate with a rectangular configuration for supporting the game board thereon, the stand further having a leg connected to each respective corner of the support plate thereof and depending downwardly therefrom for supporting the support plate and game board at an elevated position with respect to the ground;

providing a plurality of dice each with six sides having a unique number situated thereon;

providing a plurality of pieces of money;

placing a certain amount of the money on one of the game indicia;

rolling the dice; and exchanging the money in accordance with a unique set of terms relating to each game indicia.

* * * * *